US005271794A

United States Patent [19]

Jarrell et al.

[11] Patent Number: 5,271,794

[45] Date of Patent: Dec. 21, 1993

[54] ADJUSTABLE WIDTH COATING NOZZLE AND SIDE SEALER

[75] Inventors: Willis H. Jarrell, Suwanne; James L. Auten, Peachtree City, both of Ga.

[73] Assignee: Nordson Corporation, Westlake, Ohio

[21] Appl. No.: 819,082

[22] Filed: Jan. 9, 1992

[51] Int. Cl.[5] ..... B42C 9/00

[52] U.S. Cl. ..... 156/578; 156/538; 156/576; 156/908; 412/37

[58] Field of Search ..... 156/538, 576, 578, 908; 281/21.1; 412/37

[56] References Cited

U.S. PATENT DOCUMENTS

| | | | |
|---|---|---|---|
| 1,747,581 | 2/1930 | Frazier . | |
| 2,640,208 | 6/1953 | De Florez et al. . | |
| 2,660,148 | 11/1953 | Fogg . | |
| 2,774,326 | 12/1956 | Nelson . | |
| 3,071.106 | 1/1963 | Burelbach et al. . | |
| 3,285,225 | 11/1966 | Recor . | |
| 3,362,302 | 1/1968 | Friedman . | |
| 3,384.931 | 5/1968 | Cochran et al. . | |
| 3,521.602 | 7/1970 | Coghill . | |
| 3,707,418 | 12/1972 | Bhagat et al. . | |
| 3,888,722 | 6/1975 | Blair et al. | 156/477 B |
| 3,956,057 | 5/1976 | Jung | 156/578 |
| 4,145.171 | 3/1979 | Guzowski | 425/110 |
| 4,263,348 | 4/1981 | Renegar | 427/286 |
| 4,289,330 | 9/1981 | Wiermanski | 281/21 R |
| 4,371,195 | 2/1983 | Wang et al. | 281/21 R |
| 4,470,858 | 9/1984 | McMaster | 156/267 |
| 4,496,617 | 1/1985 | Parker | 428/55 |
| 4,512,945 | 4/1985 | Vigano | 264/263 |
| 4,750,956 | 6/1988 | Malachowski | 156/79 |
| 4,984,949 | 1/1991 | Reckziegel | 412/8 |
| 5,129,772 | 7/1992 | Slautterback | 412/37 |

FOREIGN PATENT DOCUMENTS

| | | |
|---|---|---|
| 1125960 | 4/1979 | Canada . |
| 3538897 | 5/1987 | Fed. Rep. of Germany . |
| 4021906 | 1/1991 | Fed. Rep. of Germany . |
| 91863 | 12/1979 | Japan . |
| 9114510 | 10/1991 | PCT Int'l Appl. . |

*Primary Examiner*—Robert A. Dawson
*Assistant Examiner*—David Reifsnyder
*Attorney, Agent, or Firm*—Wood, Herron & Evans

[57] ABSTRACT

A book spine coating nozzle is provided with adjustable side sealing jaws for adjusting the nozzle width for different book thicknesses and having distinct, separate side glue outlets for depositing glue on the book sides. Glue flow control valves are disposed between the nozzle and outlets so the glue deposited on the book sides can be selectively and independently cut off or controlled.

12 Claims, 3 Drawing Sheets

ADJUSTABLE WIDTH COATING NOZZLE AND SIDE SEALER

This invention relates to apparatus for applying adhesive to the spines of books and more particularly to adjustable width adhesive applicators for spread coating book spines and the sides thereof.

In book binding, it has been common to pass the spine or back binding over a device which applies adhesive thereto so the page edges are adhered and a binding or cover can be applied. Most of the known devices serve to apply adhesive only to the spine or page edges of the book or signature.

It is in some cases desirable to apply adhesive to the outside surfaces of the outer pages or leaves of the book, proximate or adjacent the spine, to enhance the adhesion of a cover or binding thereto. This has usually been accomplished by the provision in the application system of a second adhesive station, removed from the spine adhesive application station. This has required additional apparatus and has complicated the binding process as it has required compromises for process speeds, adhesive cooling between stations (where hot melts are used) and the like. And in any event, the variation in book width requires adjustable apparatus for controlling the adhesive application.

One prior suggestion for applying adhesive to both spine and immediate adjacent side edges is found in U.S. Pat. No. 4,512,945 which discloses adjustable side sealing jaws, each having a cut-out disposed over the spine adhesive nozzles. Adhesive flowing through the nozzle up to the spine flows into the side cut-outs so adhesive is deposited on the sides along the spine as well. While such a system might provide adhesive application to the book sides, this apparatus has several disadvantages including the difficulty of controlling the adhesive applied to the sides.

Accordingly, it has been one objective of the invention to provide improved apparatus for applying adhesive to book spines and sides.

A further objective of the invention has been to provide an improved single station apparatus for applying adhesive to book spines and sides with control of the application of adhesive to the book sides independent of the application of adhesive to the book spine.

To these ends, a preferred embodiment of the invention includes an adhesive applicator having a spine adhesive extrusion slot defined by two die bodies and a shim for applying adhesive to the book spine and feeding two adjustable width sealing jaws having side adhesive application outlets fed through independent adhesive flow control valves.

Each of the sealing jaws is provided with a grooved sealing block feeding linear recesses thereabove. These recesses communicate glue from the spine adhesive extrusion slot through an adhesive passage feeding a flow control valve and the side adhesive application outlets. The sealing jaws are independently movable, transversely, toward and away from each other to accommodate varying book widths. The linear recesses in the jaw sealing block grooves remain in communication with the spine adhesive extrusion slot, at the recess ends, so that an adhesive flow is always established to the flow control valve, for all operative book widths.

The slot-defining shim has a thickness defining the slot thickness and two side ears defining the length of the slot. These shim ears are covered by the sealing blocks of the side sealing jaws, with the respective grooves in those blocks overlying the shim, and the slot at least in part between the ears, so adhesive in the extrusion slot above the shim can flow into the grooves of the sealing blocks and up to the flow control valves.

Two adjustment knobs are attached to threaded rods having ends captured in the slot die and permitting rod rotation. The rods are threaded to end pieces on the sealing jaws and can be turned to move the sealing jaws in and out to accommodate varying book widths.

Adhesive is fed to the slot die through a valve-controlled manifold body and may be recirculated.

Accordingly, the adhesive applied to the book sides is fed by the spine supply at the same station, but is independently adjustable for precise side adhesive control for books of varying width. Also, the side adhesive can be applied in patterns along, but not necessarily in contact with the adhesive on the spine.

These and other objectives and advantages will be readily apparent from the following description of a preferred embodiment of the invention and from the drawings in which.

SPECIFICATION

Figure 1:
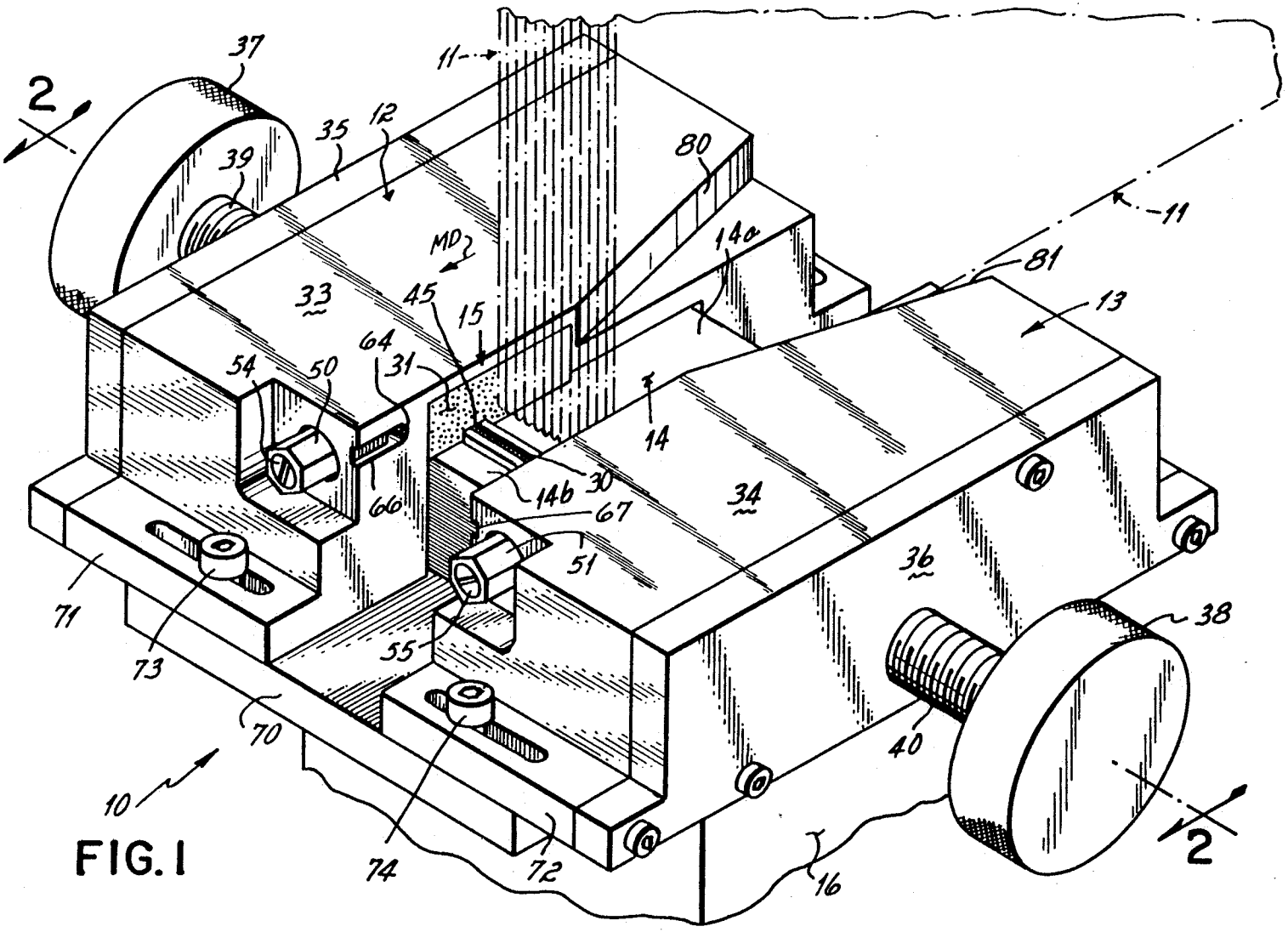
FIG. 1 is a perspective view of the invention.

A preferred embodiment of the side sealer apparatus is shown at 10 in FIG. 1. The side sealer 10 is operable to apply glue to the spine and the sides of a book 11, as shown in phantom in FIG. 1, and which is moved, in the direction of the arrow "MD", through the apparatus. The apparatus 10 includes two sealing jaws 12 and 13, forming with a two-part diebody 14 (14*a*, 14*b*) a trough 15 (FIG. 2), through which the book 11 is moved.

Figure 2:
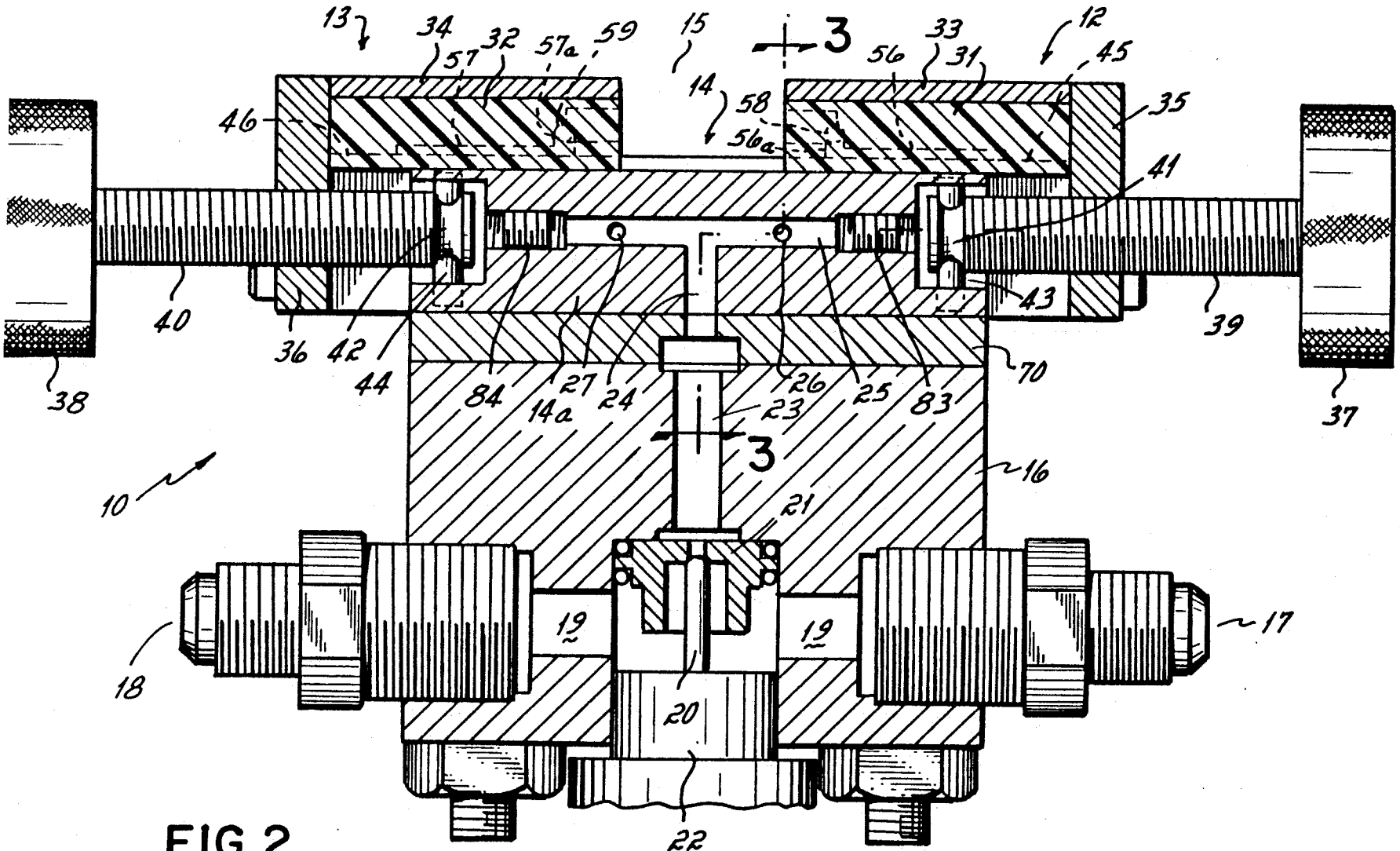
FIG. 2 is a cross-sectional view of the invention taken along lines 2—2 of FIG. 1.

As perhaps best shown in FIG. 2, the diebody 14 is mounted atop a manifold 16, housing a glue inlet and outlet 17 and 18 respectively. These inlets and outlets are ported to a bore 19 within the manifold 16, in which is located a valve stem 20 and a seat 21. As shown in FIG. 2, the stem 20 engages seat 21 to cut off the flow of glue. However, when the valve stem is retracted by any suitable means, such as piston 22, glue can flow through the bore 19 and into a first glue passage 23, where the glue flows upwardly into the passageway 24 within the diebody 14. The passageway 24 is connected to a transverse passage 25, which in turn is connected to two elongated passageways 26 and 27.

The diebody 14 has two parts, a rearward body portion 14*a*, and a forward or downstream body portion 14*b*. The diebody portions 14*a* and 14*b* are spaced apart by a shim 29, forming, above the shim between the die portions 14*a* and 14*b*, an extrusion slot 30. The slot 30 is defined by elongated upstanding lips 14*c*, 14*d* (FIGS. 3 and 4).

Each of the sealing jaws 12 and 13 includes a sealing block 31, 32, a jaw body 33, 34, and endcaps 35, 36 (perhaps best seen in FIG. 2). The jaws 12, 13 are respectively movable toward and away from each other. This is accomplished by means of adjusting knobs 37, 38, each of which are attached to respective threaded rods 39, 40, which have grooves 41, 42 in their inward ends. Pins 43 and 44 extend through the diebody portion 14*a*, in engagement with the respective grooves 41, 42, to rotatably capture the respective rods 39 and 40 in the diebody. The endcaps 35 and 36 are respectively threaded to cooperate with the rods 39 and 40. Thus, when the knobs 37 or 38 are turned, the rods 39 and 40 turn and the endcaps 35, 36 are translated transversely toward and away from each other as the rods 39, 40 are turned. This motion moves the entire sealing jaws 12, 13 toward and away from each other, carrying with them the sealing blocks 31, 32.

Figure 4:
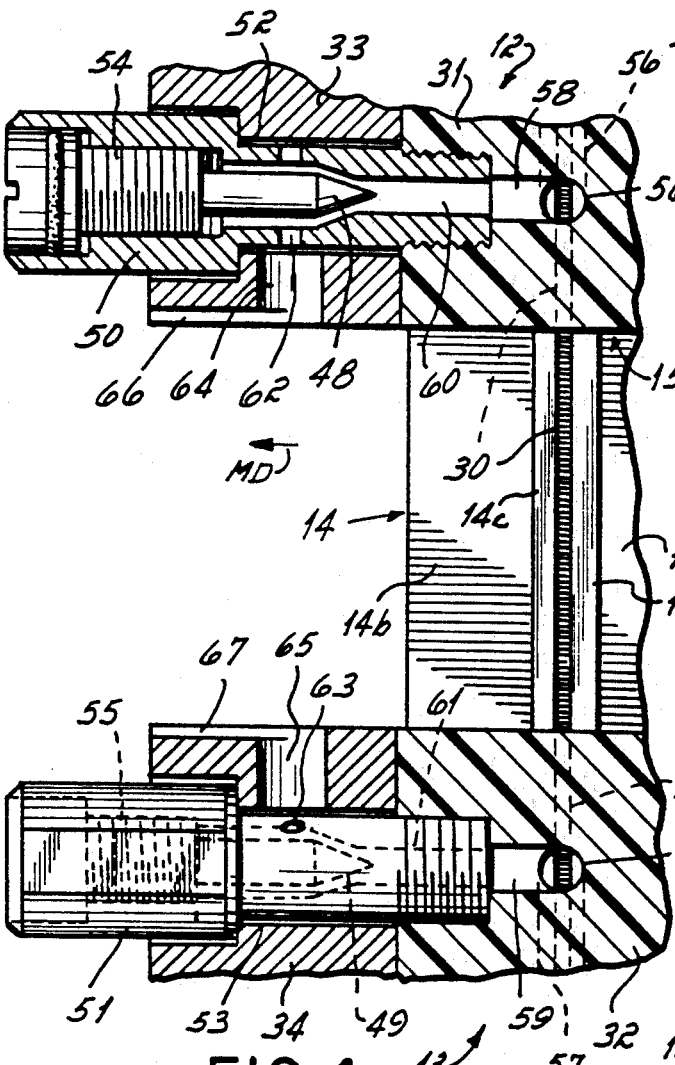
FIG. 4 is a cross-sectional view of the invention taken along lines 4—4 of FIG. 3.

As perhaps best seen in FIG. 4, each of the sealing jaws also carries with it glue flow controlling valves, such as the needle valves illustrated in FIG. 4 at 48, 49. These valves 48, 49 are mounted in inserts 50, 51, extending through bores 52, 53 in the jaw bodies 33, 34 respectively. The valves 48, 49 are attached to screws 54, 55, which extend forwardly from the respective jaws as shown in FIG. 1 and in FIG. 4, and these flow control valves 48, 49, are used selectively to cut-off or to control the flow of glue to the sides of the book, as will be described.

Figure 3:
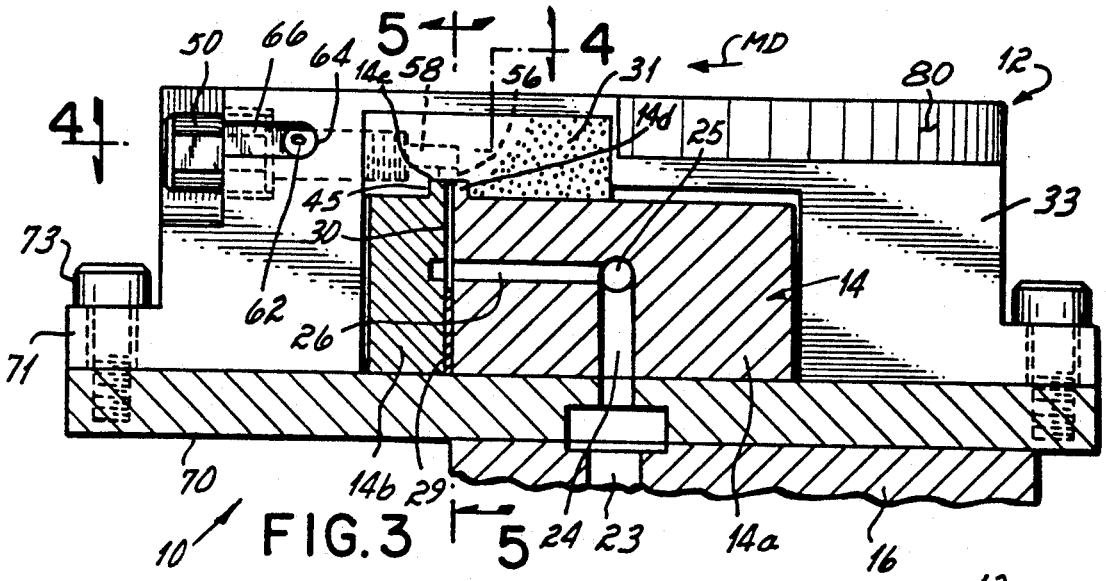
FIG. 3 is a cross-sectional view of the invention taken along lines 3—3 of FIG. 2.

Returning now to the sealing blocks 31 and 32, each sealing block is provided with a groove 45, 46, disposed transversely in the sealing block, and as shown perhaps best in FIG. 3, in the same direction as, and over the extrusion slot 30. These grooves 45, 46 receive die lips 14*c*, 14*d*. Each of these grooves 45 and 46 is connected through a linear recess 56, 57, associated with vertical passages 56*a* and 57*a*, to a forwardly extending passageway 58, 59, each of which is respectively in communication with a bore 60, 61, through the insert 50, 51. Each of the inserts is also provided with a radial through bore 62, 63. When the inserts 50, 51 are in place within the jaw bodies 33 and 34, the bores 62, 63 communicate with glue passageways 64 and 65, where they communicate respectively with elongated outlet ports 66, 67, which are elongated in a direction of arrow MD for depositing glue on the sides of the book.

It will be appreciated that the manifold may be provided with flanges such as flange 70. The bodies of the sealing jaws 33, 34 are provided with flanges 71, 72. These respective flanges can be secured to the manifold by means of fasteners 73, 74, once the jaws are moved to the appropriate spaced apart position for receiving a book. Similar flanges and hold down screws may be positioned at the rearward end of the jaw bodies 33, 34 as well, and as shown in FIG. 3.

Figure 5:
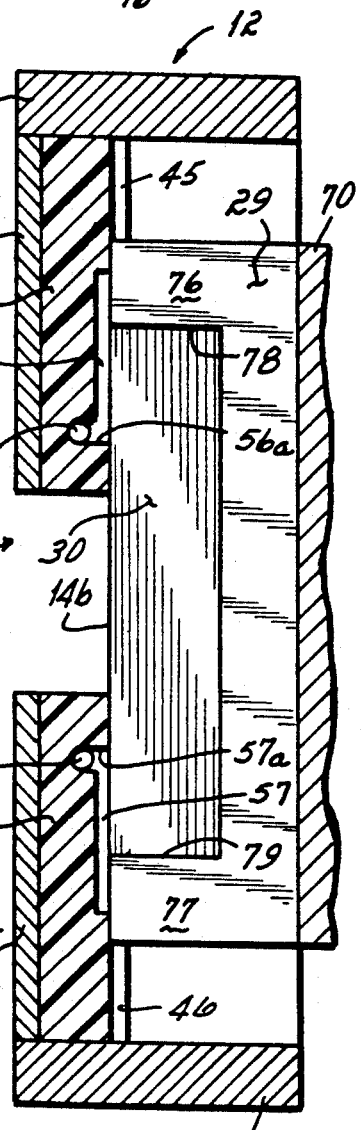
FIG. 5 is a cross-sectional view of the invention taken along lines 5—5 of FIG. 3 and illustrating diagrammatically the shim and sealing jaw relationship of the invention.

Turning now briefly to FIG. 5, the construction of shim 29 will be more readily apparent as viewed in FIG. 5. The view in FIG. 5 is looking downstream in terms of the movement of the book (just as is FIG. 2), and the cross section of FIG. 5 is taken from a position further downstream than FIG. 2. Thus, the adjusting knobs and the glue passageways and the die blocks are not shown in FIG. 5.

In FIG. 5, however, it will be seen that the shim 29 has two upstanding ears, or ends 76 and 77. These ears 76 and 77 have inner edges 78, 79, which define the length of the slot 30, as seen in FIG. 5. Of course, the thickness of the shim defines the width or thickness of the slot 30, as best seen perhaps in FIG. 3. It will thus be appreciated that the grooves 45, 46 in the sealing blocks 31, 32, lie directly over and along the slot 30, as defined by the shim 29.

It will also be appreciated that when adjusted, the jaws 12, 13 will not be pulled so far apart as to permit the glue in recesses 56, 57 to escape from the recesses at their outer ends beyond the ends 76, 77 of shim 29.

It will also be appreciated that each of the jaw bodies 33, 34 are provided with guide surfaces 80, 81, which are tapered into the trough 15 for guiding books therein.

It will also be appreciated that the transverse passageway 25 in the die block part 14*a*, is plugged off at its ends by two threaded plugs 83, 84, as shown in FIG. 2.

In use, a book is introduced in the direction of the arrow MD to the apparatus 10 with the spine moving through trough 15. The valve stem 20 is withdrawn and glue is admitted through the passageways 23 through 27, to the slot area 30, where glue exudes from the open mouth of the slot in an upward direction. The length of the slot is defined by the shim ears 76, 77, the shim being selected to provide the desired slot thickness and desired slot length. It will be appreciated that one shim can be used for a variety of different width books, since the jaws 12 and 13 are movable transversely toward and apart from each other. This movement is accommodated by the length of the passage or glue recesses 56 and 57 located in the sealing blocks 31 and 32, respectively. As the jaws are moved inwardly or outwardly, the recesses 56 and 57 move along the open end of the slot 30 to receive glue exuding from the slot between the inner edge of the sealing jaws adjacent the book and the respective ears 76, 77.

In any case, it will be appreciated that glue exuding through the slot is free to coat the spine of the book 11 between the jaws 12 and 13. It will also be appreciated, as perhaps best seen in FIGS. 3, 4 and 5, that glue can also exude from the slot 30 upwardly into the recesses 56 and 57, in their respective sealing blocks 31, 32. From there, the glue moves upwardly through the passageways 56*a* and 57*a* at the inward ends of the recesses, and through the sealing block into the jaw bodies 33 and 34, respectively, and into the inserts 50, 51.

The screws 54 and 55 are turned to position the valve stems 48, 49 within the bores 60 and 61 of the inserts. This controls the flow of glue into the passageways 64, 65, and to the respective glue deposition outlets or ports 66, 67, for application to the sides of the book 11.

Accordingly, the glue is exuded from slot 30 onto the spine of the book and through the various passages as described in the sealing block and the jaws, to the ports 66 and 67, for deposition on the sides of the book. Nevertheless, the flow of glue onto the sides of the book is independently controlled by the valves 48 and 49, irrespective of the amount of glue that is being applied to the book's spine. Also, the glue may be, depending on the position of outlets 66, 67, deposited proximate to but spaced apart from the glue deposited on the book spine.

Accordingly, it will be appreciated that the invention has provided an apparatus by which glue can be deposited, not only on the spine of the book, but on the sides of the book at the same station, and yet with the amount of glue flowing onto the sides of the book being independently controlled. The sealing blocks within the jaw bodies restrict flow from the slot 30, as the jaws are adjusted. By sectioning off the portion of the slot or glue nozzle 30, which is not required for coating, the adhesive is discharged through a flow control means for side sealing.

Of course, it will be appreciated that a variety of glues or adhesives can be utilized, such as hot melt adhesive, polyurethane adhesives and the like, as desired. It will also be appreciated that the glue can cleanly be cut off by the valve 20 from the whole system when it is desired to change over or to shut down the process for a break.

It will also be appreciated that by selective and independent movement of the side glue flow control valves, glue could be applied to one side of the book, but not the other.

Accordingly, the invention provides single station spine and side applications of adhesives to books or signatures having varied widths and with independent control of the glue flowing to the book sides.

These and other modifications and advantages will be readily apparent to those of ordinary skill in the field to which the invention pertains, without departing from the scope of the invention, and the applicant intends to be bound only by the claims appended hereto:

We claim:

1. Apparatus for applying glue to the spine and side edges of a book including:

a die defining a slot for exuding glue onto a book spine at an adhesive station; and two movable sealing jaws for applying glue to the sides of a book through respective outlet ports at said station;

said sealing jaws each including:

a sealing means having a glue passageway therein for receiving glue form said slot and for transporting glue to said outlet port, and glue flow control means operably disposed within said passageway for controlling the flow of glue from said die slot to said outlet port wherein said sealing means has an elongated recess extending along said slot and said glue passageway communicates within an inboard end of said recess for receiving glue from said slot and recess when said slot exudes glue for coating said book spine.

2. Apparatus as in claim 1 wherein said slot is defined in party by a shim underlying said slot in said die, said shim having two enlarged ends sealing off and defining ends of said die slot.

3. Apparatus as in claim 1 wherein said sealing jaws are threaded to rotatable rods having ends journaled in said die so that said jaws are movable toward and away from each other, when said rods are turned, in order to accommodate varying book widths.

4. Apparatus as in claim 1 further including a glue supply manifold and valve means therein for flowing or cutting off flow of glue from said die.

5. Apparatus as in claim 4 including a glue passageway in said die between said supply manifold and said slot.

6. Apparatus as in claim 1 wherein said glue outlet ports in said sealing jaws comprise outlet ports which are elongated in a direction perpendicular to said slot.

7. Apparatus as in claim 6 wherein glue flow control means comprises adjustable needle valves for selectively cutting off the flow of glue to said outlet ports and selectively controlling the flow of glue therethrough.

8. Apparatus for applying glue to the spines and sides of book and comprising:

an extrusion slot for applying glue to the spines of books, said slot having an elongated glue outlet; and two movable sealing jaws disposed adjacent said outlet and movable toward and away from each other;

said sealing jaws each including:

a glue outlet port for applying glue to a side of said books, a sealing means for sealing off a portion of said slot and having a recess extending in the same direction of the extrusion slot;

a glue passageway extending between said recess in said sealing means and said glue outlet port, and glue flow control means disposed in said glue passageway.

9. Apparatus for applying glue to the spine of a book and to the sides of a book at a single station comprising:

a glue manifold;

a glue flow control valve in said manifold;

a die means defining an elongated glue outlet from which glue is applied to said spine;

a first glue passageway operably connecting said flow control valve to said slot;

two opposed, movable, sealing jaws disposed over said slot and each having a sealing block with a groove therein extending over and along a portion of said slot;

a glue outlet in each said jaw opening toward the opposite jaw for depositing glue on the sides of a book;

a second glue passageway extending from said groove in each said sealing block to said glue outlet in said jaw; and a second glue flow control valve means in each said second glue passageway for controlling glue applied to said book sides independent of glue applied to said spine; and means for moving said jaws toward and away from each other over said slot for accommodating books of varying widths therebetween while retaining the capacity to selectively apply glue to the book sides.

10. Apparatus as in claim 9 wherein said jaws each include an end piece and wherein a threaded rod is coupled to said die means and threaded to an end piece for moving said jaws toward and away from each other.

11. Apparatus as in claim 9 wherein said slot in said die means is defined by a shim having ends extending into said slot toward respective sealing blocks, said slot being defined by said shim and the length of said slot defined by the distance between said two shim ends.

12. Apparatus as in claim 9 wherein second glue flow control valve means can be independently operated to control the deposition or absence of glue on each side of a book.

* * * * *